US008908876B2

(12) United States Patent
Magrath et al.

(10) Patent No.: US 8,908,876 B2
(45) Date of Patent: Dec. 9, 2014

(54) NOISE CANCELLATION SYSTEM WITH LOWER RATE EMULATION

(75) Inventors: Anthony James Magrath, Edinburgh (GB); Richard Clemow, Gerrards Cross (GB)

(73) Assignee: Wolfson Microelectronics Ltd., Edinburgh (GB)

( * ) Notice: Subject to any disclaimer, the term of this patent is extended or adjusted under 35 U.S.C. 154(b) by 1126 days.

(21) Appl. No.: 12/808,931

(22) PCT Filed: Dec. 12, 2008

(86) PCT No.: PCT/GB2008/051182

§ 371 (c)(1),
(2), (4) Date: Aug. 18, 2010

(87) PCT Pub. No.: WO2009/081187

PCT Pub. Date: Jul. 2, 2009

(65) Prior Publication Data

US 2010/0310086 A1 Dec. 9, 2010

(30) Foreign Application Priority Data

Dec. 21, 2007 (GB) ..... 0725111.9
Jun. 16, 2008 (GB) ..... 0810995.1

(51) Int. Cl.
*G10K 11/16* (2006.01)
*G10K 11/178* (2006.01)

(52) U.S. Cl.
CPC ..... *G10K 11/178* (2013.01); *G10K 2210/1081* (2013.01); *G10K 2210/3051* (2013.01); *G10K 2210/3028* (2013.01)
USPC ... 381/71.1; 381/71.11; 381/71.6; 381/71.12; 381/94.1

(58) Field of Classification Search
None
See application file for complete search history.

(56) References Cited

U.S. PATENT DOCUMENTS

| | | | | |
|---|---|---|---|---|
| 5,329,587 | A | 7/1994 | Morgan et al. | |
| 5,636,286 | A | 6/1997 | Makabe et al. | |
| 5,828,589 | A * | 10/1998 | Degenhardt | 708/322 |
| 5,917,919 | A | 6/1999 | Rosenthal | |
| 7,433,463 | B2 * | 10/2008 | Alves et al. | 379/406.01 |
| 7,716,046 | B2 * | 5/2010 | Nongpiur et al. | 704/226 |
| 8,019,007 | B2 * | 9/2011 | Boppana et al. | 375/260 |
| 2007/0030442 | A1 * | 2/2007 | Howell et al. | 351/158 |
| 2007/0237349 | A1 * | 10/2007 | Donaldson et al. | 381/380 |
| 2008/0107282 | A1 * | 5/2008 | Asada | 381/71.14 |
| 2008/0269926 | A1 * | 10/2008 | Xiang et al. | 700/94 |

FOREIGN PATENT DOCUMENTS

| | | | |
|---|---|---|---|
| EP | 0 622 778 | A2 | 11/1994 |
| EP | 1 921 601 | A2 | 5/2008 |
| JP | 5-313672 | A | 11/1993 |
| WO | WO 95/13655 | A1 | 5/1995 |
| WO | WO 97/02559 | A1 | 1/1997 |
| WO | WO 02/059497 | A2 | 8/2002 |

* cited by examiner

*Primary Examiner* — Duc Nguyen
*Assistant Examiner* — Taunya McCarthy
(74) *Attorney, Agent, or Firm* — Dickstein Shapiro LLP

(57) ABSTRACT

There is provided a noise cancellation system, comprising: an input for a digital signal, the digital signal having a first sample rate; a digital filter, connected to the input to receive the digital signal; a decimator, connected to the input to receive the digital signal and to generate a decimated signal at a second sample rate lower than the first sample rate; and a processor. The processor comprises: an emulation of the digital filter, connected to receive the decimated signal and to generate an emulated filter output; and a control circuit, for generating a control signal on the basis of the emulated filter output. The control signal is applied to the digital filter to control a filter characteristic thereof.

27 Claims, 14 Drawing Sheets

NOISE CANCELLATION SYSTEM WITH LOWER RATE EMULATION

This invention relates to a noise cancellation system, and in particular to a noise cancellation system having a filter that can easily be adapted based on an input signal in order to improve the noise cancellation performance.

BACKGROUND

Noise cancellation systems are known, in which an electronic noise signal representing ambient noise is applied to a signal processing circuit, and the resulting processed noise signal is then applied to a speaker, in order to generate a sound signal. In order to achieve noise cancellation, the generated sound should approximate as closely as possible the inverse of the ambient noise, in terms of its amplitude and its phase.

In particular, feedforward noise cancellation systems are known, for use with headphones or earphones, in which one or more microphones mounted on the headphones or earphones detect an ambient noise signal in the region of the wearer's ear. In order to achieve noise cancellation, the generated sound then needs to approximate as closely as possible the inverse of the ambient noise, after that ambient noise has itself been modified by the headphones or earphones. One example of modification by the headphones or earphones is caused by the different acoustic path the noise must take to reach the wearer's ear, travelling around the edge of the headphones or earphones.

The microphone or microphones used to detect the ambient noise signal and the loudspeaker used to generate the sound signal from the processed noise signal will in practice also modify the signals, for example being more sensitive at some frequencies than at others. One example of this is when the speaker is closely coupled to the ear of a user, causing the frequency response of the loudspeaker to change due to cavity effects.

It is advantageous to be able to adapt the characteristics of a filter that is used in the signal processing circuitry, for example in order to take account of the properties of the ambient noise. However, with the use of high sampling rates, this adaptation of the filter can use significant amounts of power.

SUMMARY OF INVENTION

According to a first aspect of the present invention, there is provided a noise cancellation system, comprising: an input for a digital signal, the digital signal having a first sample rate; a digital filter, connected to the input to receive the digital signal; a decimator, connected to the input to receive the digital signal and to generate a decimated signal at a second sample rate lower than the first sample rate; and a processor. The processor comprises an emulation of the digital filter, connected to receive the decimated signal and to generate an emulated filter output; and a control circuit, for generating a control signal on the basis of the emulated filter output, wherein the control signal is applied to the digital filter to control a filter characteristic thereof.

This has the advantage that the digital filter can be controlled on the basis of the input signal, but without requiring power-intensive generation of the control signal to be applied to the filter.

According to a second aspect of the present invention, there is provided a method of cancelling ambient noise. The method comprises: receiving a digital signal, the digital signal having a first sample rate; filtering said signal with a digital filter; generating a decimated signal from said digital signal, the decimated signal having a second sample rate lower than the first sample rate; emulating the digital filter using said decimated signal, generating an emulated filter output; and controlling a filter characteristic of the digital filter on the basis of the emulated filter output.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1:
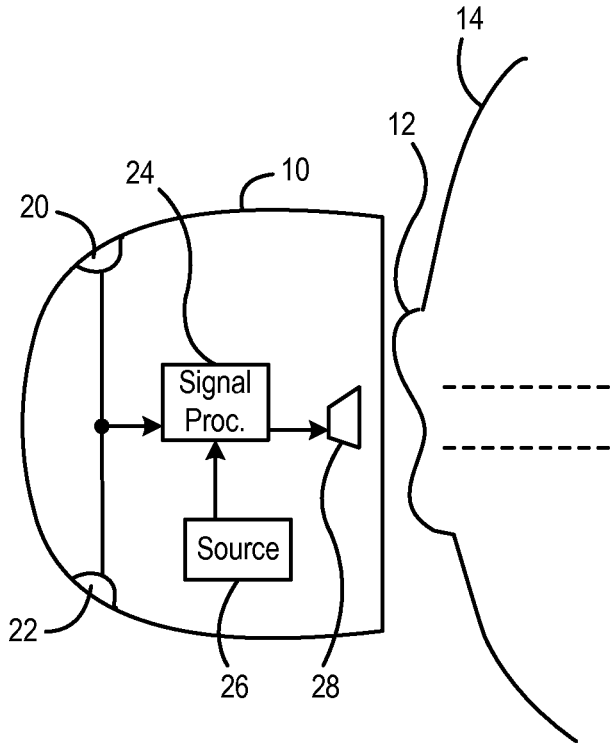
FIG. 1 illustrates a noise cancellation system in accordance with an aspect of the invention.

FIG. 1 illustrates in general terms the form and use of an audio spectrum noise cancellation system in accordance with the present invention.

Specifically, FIG. 1 shows an earphone 10, being worn on the outer ear 12 of a user 14. Thus, FIG. 1 shows a supra-aural earphone that is worn on the ear, although it will be appreciated that exactly the same principle applies to circumaural headphones worn around the ear and to earphones worn in the ear such as so-called ear-bud phones. The invention is equally applicable to other devices intended to be worn or held close to the user's ear, such as mobile phones, headsets and other communication devices.

Ambient noise is detected by microphones 20, 22, of which two are shown in FIG. 1, although any number more or less than two may be provided. Ambient noise signals generated by the microphones 20, 22 are combined, and applied to signal processing circuitry 24, which will be described in more detail below. In one embodiment, where the microphones 20, 22 are analogue microphones, the ambient noise signals may be combined by adding them together. Where the microphones 20, 22 are digital microphones, i.e. where they generate a digital signal representative of the ambient noise, the ambient noise signals may be combined alternatively, as will be familiar to those skilled in the art. Further, the microphones could have different gains applied to them before they are combined, for example in order to compensate for sensitivity differences due to manufacturing tolerances.

This illustrated embodiment of the invention also contains a source 26 of a wanted signal. For example, where the noise cancellation system is in use in an earphone, such as the earphone 10 that is intended to be able to reproduce music, the source 26 may be an inlet connection for a wanted signal from an external source such as a sound reproducing device, e.g. an MP3 player. In other applications, for example where the noise cancellation system is in use in a mobile phone or other communication device, the source 26 may include wireless receiver circuitry for receiving and decoding radio frequency signals. In other embodiments, there may be no source, and the noise cancellation system may simply be intended to cancel the ambient noise for the user's comfort.

The wanted signal, if any, from the source 26 is applied through the signal processing circuitry 24 to a loudspeaker 28, which generates a sound signal in the vicinity of the user's ear 12. In addition, the signal processing circuitry 24 generates a noise cancellation signal that is also applied to the loudspeaker 28.

One aim of the signal processing circuitry 24 is to generate a noise cancellation signal, which, when applied to the loudspeaker 28, causes it to generate a sound signal in the ear 12 of the user that is the inverse of the ambient noise signal reaching the ear 12 such that ambient noise is at least partially cancelled.

In order to achieve this, the signal processing circuitry 24 needs to generate from the ambient noise signals generated by the microphones 20, 22 a noise cancellation signal that takes into account the properties of the microphones 20, 22 and of the loudspeaker 28, and also takes into account the modification of the ambient noise that occurs due to the presence of the earphone 10.

Figure 2:
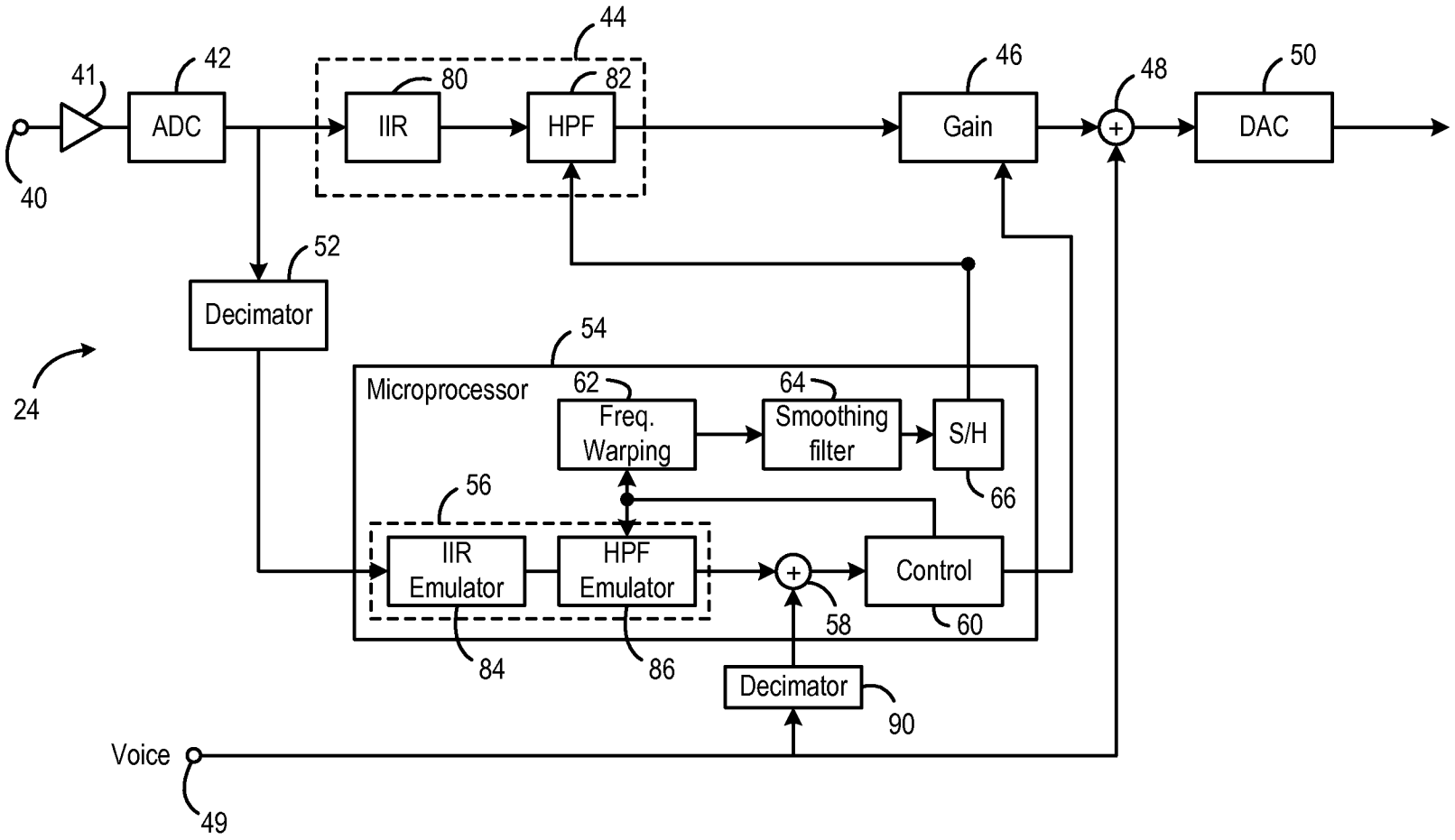
FIG. 2 illustrates a signal processing circuit in accordance with an aspect of the invention in the noise cancellation system of FIG. 1.

FIG. 2 shows in more detail the form of the signal processing circuitry 24. An input 40 is connected to receive an input signal, for example directly from the microphones 20, 22. This input signal is applied to an analog-digital converter 42, where it is converted to a digital signal. The resulting digital signal is then applied to an adaptable digital filter 44, and the resulting filtered signal is applied to an adaptable gain device 46.

The output signal of the adaptable gain device 46 is applied to an adder 48, where it is summed with the wanted source signal received from a second input 49, to which the source 26 may be connected. Of course, this applies to embodiments in which a wanted signal is present. In embodiments where no wanted signal is present (i.e. the noise cancellation system is designed purely to reduce ambient noise, for example in high-noise environments), the input 49 and adder 48 are redundant.

Thus, the filtering and level adjustment applied by the filter 44 and the gain device 46 are intended to generate a noise cancellation signal that allows the detected ambient noise to be cancelled.

The output of the adder 48 is applied to a digital-analog converter 50, so that it can be passed to the loudspeaker 28.

As mentioned above, the noise cancellation signal is produced from the input signal by the adaptable digital filter 44 and the adaptable gain device 46. These are controlled by one or more control signals, which are generated by applying the digital signal output from the analog-digital converter 42 to a decimator 52 which reduces the digital sample rate, and then to a microprocessor 54.

The microprocessor 54 contains a block 56 that emulates the filter 44 and gain device 46, and produces an emulated filter output which is applied to an adder 58, where it is summed with the wanted signal from the second input 49, via a decimator 90. The sample rate reduction performed by the decimator 52 allows the emulation to be performed with lower power consumption than performing the emulation at the original 2.4 MHz sample rate.

The resulting signal is applied to a control block 60, which generates control signals for adjusting the properties of the filter 44 and the gain device 46. The control signal for the filter 44 is applied through a frequency warping block 62, a smoothing filter 64 and sample-and-hold circuitry 66 to the filter 44. The same control signal is also applied to the block 56, so that the emulation of the filter 44 matches the adaptation of the filter 44 itself. In one embodiment, the control signal for the filter 44 is generated on the basis of a comparison of the output of the adder 58 with a threshold value. For example, if the output of the adder 58 is too high, the control block 60 may generate a control signal such that the output of the filter 44 is lowered. In one embodiment, this may be through lowering the cut-off frequency of the filter 44.

The purpose of the frequency warping block 62 is to adapt the control signal output from the control block 60 for the high-frequency adaptive filter 82. That is, the high-frequency filter 82 will generally be operating at a frequency that is much higher than that of the low-frequency filter emulator 86, and therefore the control signal will generally need to be adapted in order to be applicable to both filters. The frequency warping may therefore be replaced by any general mapping function.

The smoothing filter smoothes out any ripples in the control signal generated by the control block 60, such that noise in the system is reduced. In an alternative embodiment, the sample-and-hold circuitry 66 may be replaced by an interpolation filter.

The control block 60 further generates a control signal for the adaptive gain device 46. In the illustrated embodiment, the gain control signal is output directly to the gain device 46.

In the preferred embodiment of the invention, the digital signal applied to the device is oversampled. That is, the sample rate of the digital signal is many times higher than the Nyquist frequency that would be required to deal with the frequency range of interest. However, the higher sample rate is used in conjunction with a lower bit precision, in order to allow faster processing in the digital filter 44 with an acceptably high level of accuracy. For example, in one embodiment of the invention, the sample rate of the digital signal is 2.4 MHz.

However, it has been found that it is not necessary to operate the microprocessor 54 and the filter emulation 56 at such a high sample rate. Thus, in this illustrated embodiment, the decimator 52 reduces the sample rate to 8 kHz, a sample rate which can comfortably be handled by the microprocessor 54, whilst still keeping the power consumption low.

Although FIG. 2 shows the control signal being applied first to the frequency warping block 62, and then to the smoothing filter 64, the positions of these blocks may be interchanged.

The frequency warping block 62 is based on a bilinear transform, which ensures that the control coefficient derived from the low rate emulation is converted correctly into the control coefficient that must be applied to the filter 44 operating at the high sample rate, in order to achieve the intended control.

In this illustrated embodiment of the invention, the digital filter 44 comprises a fixed stage 80, taking the form of a sixth-order IIR filter, whose filter characteristic may be adjusted during a calibration phase but thereafter remains fixed, and an adaptive stage 82, taking the form of a high-pass filter, whose filter characteristic can be adapted in use based on the properties of the input signal. In this way, the characteristic of the digital filter 44 can be adapted based on the ambient noise. In one embodiment, the filter characteristic is the cut-off frequency of the digital filter 44.

The block 56 which emulates the digital filter 44 therefore also contains a fixed stage 84, whose filter characteristic may be adjusted during a calibration phase but thereafter remains fixed, and an adaptive stage 86, taking the form of a high-pass filter, whose filter characteristic can be adapted in use based on the properties of the input signal, and in particular based on the output of the control block 60.

Although the fixed stage 80 of the digital filter 44 is a sixth-order IIR filter, the fixed stage 84 of the emulation 56 may be a lower-order IIR filter, for example a second-order IIR filter, and this may still provide an acceptably accurate emulation.

Further, the microprocessor 54 may comprise an adaptive gain emulator (not shown in FIG. 2), located in between the filter emulator 56 and the adder 58. In this instance, the control block 60 will also output the gain control signal to the adaptive gain emulator.

Various modifications may be made to the embodiments described above without departing from the scope of the claims appended hereto. For example, the source signal input to the signal processor 24 may be digital, as described above, or analogue, in which case an analog-digital converter may be necessary to convert the signal to digital. Further, the digital source signal may be decimated in a decimating filter (not shown).

As discussed above, the digital signal representing the detected ambient noise is applied to an adaptive digital filter 44, in order to generate a noise cancellation signal. In order to be able to use the signal processing circuitry 24 in a range of different applications, it is necessary for the adaptive digital filter 44 to be relatively complex, so that it can compensate for different microphone and speaker combinations, and for different types of earphone having different effects on the ambient noise.

However, it would be disadvantageous to have to perform full adaptation on a complex filter, such as an IIR filter, in use of the device. Thus, in this preferred embodiment of the invention, the filter 44 includes an IIR filter 80 having a filter characteristic that is effectively fixed while the device is in operation. More specifically, the IIR filter may have several possible sets of filter coefficients, the filter coefficients together defining the filter characteristic, with one of these sets of filter coefficients being applied based on the microphone 20, 22, speaker 28, and earphone 10 with which the signal processing circuitry 24 is being used.

The setting of the IIR filter coefficients may take place when the device is manufactured, or when the device is first inserted in a particular earphone 10, or as a result of a calibration process that occurs on initial power-up of the device or at periodic intervals (such as once per day, for example). Thereafter, the filter coefficients are not changed, and the filter characteristic is fixed, rather than being adapted on the basis of the signal being applied thereto.

However, it has been found that this may have the disadvantage that the device may not perform optimally under all conditions. For example, in situations where there is a relatively high level of low frequency noise, the resulting noise cancellation signal would be at a level that is higher than could be handled by a typical speaker 28.

Thus, the filter 44 also includes an adaptive component, in this illustrated example an adaptive high-pass filter 82. The properties of the high-pass filter, such as its cut-off frequency, can then be adjusted on the basis of the control signal generated by the microprocessor 54. Moreover, the adaptation of the filter 44 can then take place on the basis of a much simpler control signal.

The use of a filter that contains a fixed part and an adaptive part therefore allows for the use of a relatively complex filter, but allows for the adaptation of that filter by means of a relatively simple control signal.

Figure 14:
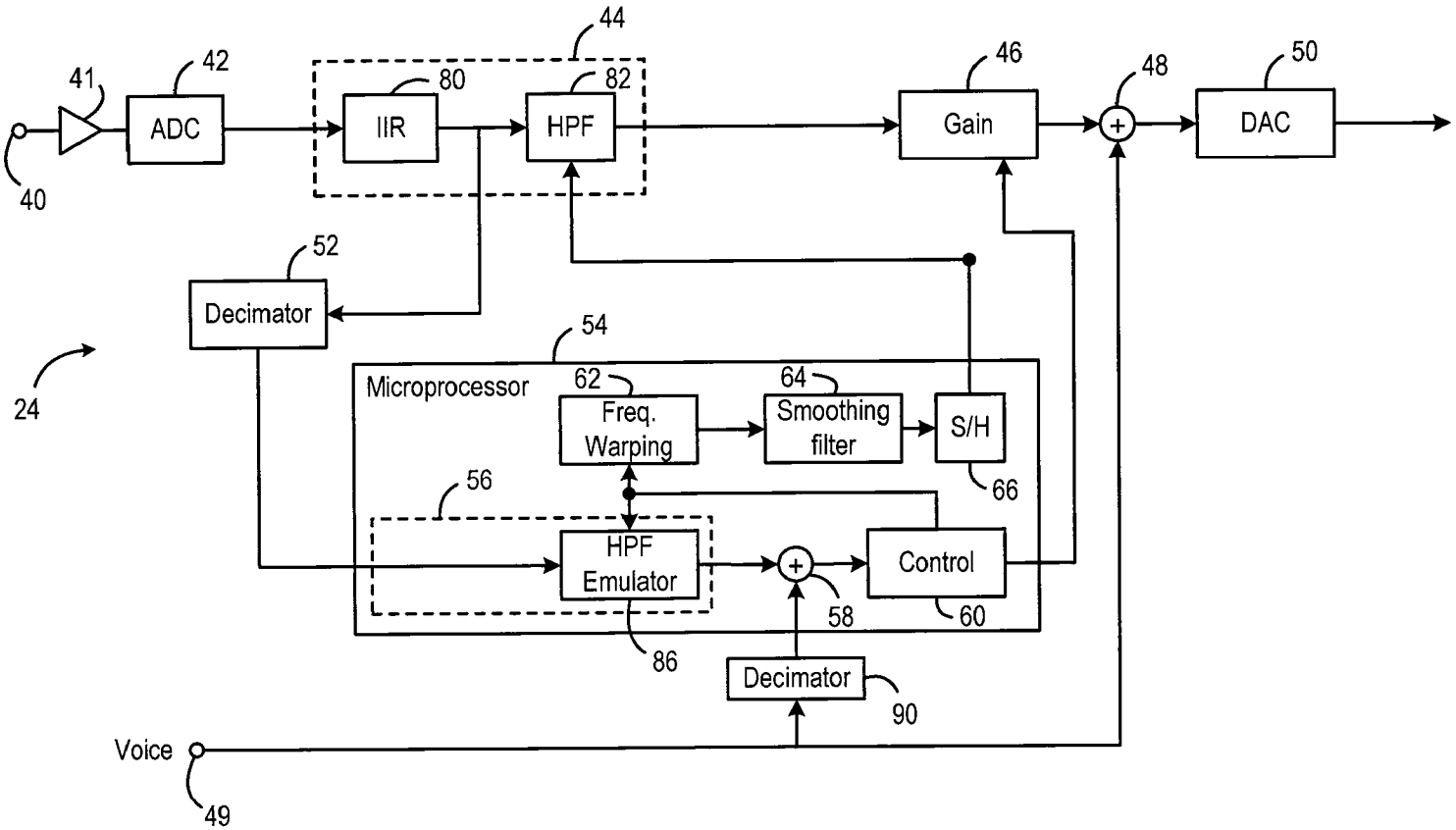
FIG. 14 illustrates a signal processing circuit in accordance with an aspect of the invention in the noise cancellation system of FIG. 1.

As described so far, the adaptation of the filter 44 takes place on the basis of a control signal that is derived from the input to the filter. However, it is also possible that the adaptation of the filter 44 could take place on the basis of a control signal that is derived from the filter output. Moreover, the division of the filter into a fixed part and an adaptive part allows for the possibility that the adaptation of the filter 44 could take place on the basis of a control signal that is derived from the output of the first of these filter stages. In particular, where, as illustrated, the signal is applied first to the fixed filter stage 80 and then to the adaptive filter stage 82, the adaptation of the adaptive filter stage 82 could take place on the basis of a control signal that is derived from the output of the fixed filter stage 80 (as illustrated in FIG. 14).

As mentioned above, the control signal is generated by a microprocessor 54 which contains an emulation of the filter 44. Therefore, where the filter 44 contains a fixed stage 80 and an adaptive stage 82, the emulation 56 should preferably also contain a fixed stage 84 and an adaptive stage 86, so that it can be adapted in the same way.

In this illustrated embodiment of the invention, the filter 44 comprises a fixed IIR filter 80 and an adaptive high-pass filter 82, and the filter emulation 56 similarly comprises a fixed IIR filter 84 and an adaptive high-pass filter 86, which either mirror, or are sufficiently accurate approximations of, the filters which they emulate.

However, the invention may be applied to any filter arrangement, in which the filter comprises a filter stage or multiple filter stages, provided that at least one such stage is adaptive. Moreover, the filter may be relatively complex, such as an IIR filter, or may be relatively simple, such as a low-order low-pass or high-pass filter.

Further, the possible filter adaptation may be relatively complex, with several different parameters being adaptive, or may be relatively simple, with just one parameter being adaptive. For example, in the illustrated embodiment, the adaptive high-pass filter 82 is a first-order filter controllable by a single control value, which has the effect of altering the filter corner frequency. However, in other cases the adaptation may take the form of altering several parameters of a higher order filter, or may in principle take the form of altering the full set of filter coefficients of an IIR filter.

It is well known that, in order to process digital signals, it is necessary to operate with signals that have a sample rate that is at least twice the frequency of the information content of the signals, and that signal components at frequencies higher than half the sampling rate will be lost. In a situation where signals at frequencies up to a cut-off frequency must be handled, there is thus defined the Nyquist sampling rate, which is twice this cut-off frequency.

A noise cancellation system is generally intended to cancel only audible effects. As the upper frequency of human hearing is typically 20 kHz, this would suggest that acceptable performance could be achieved by sampling the noise signal at a sampling rate in the region of 40 kHz. However, in order to achieve adequate performance, this would require sampling the noise signal with a relatively high degree of precision, and there would inevitably be delays in the processing of such signals.

In the illustrated embodiment of the invention, therefore, the analog-digital converter 42 generates a digital signal at a sample rate of 2.4 MHz, but with a bit resolution of only 3 bits. This allows for acceptably accurate signal processing, but with much lower signal processing delays. In other embodiments of the invention, the sample rate of the digital signal may be 44.1 kHz, or greater than 100 kHz, or greater than 300 kHz, or greater than 1 MHz.

As described above, the filter 44 is adaptive. That is, a control signal can be sent to the filter to change its properties, such as its frequency characteristic. In the illustrated embodiment of this invention, the control signal is sent not at the sampling rate of the digital signal, but at a lower rate. This saves power and processing complexity in the control circuitry, in this case the microprocessor 54.

The control signal is sent at a rate that allows it to adapt the filter sufficiently quickly to handle changes that may possibly produce audible effects, namely at least equal to the Nyquist sampling rate defined by a desired cut-off frequency in the audio frequency range.

Although it would be desirable to be able to achieve noise cancellation across the whole of the audio frequency range, in practice it is usually only possible to achieve good noise cancellation performance over a part of the audio frequency range. In a typical case, it is considered preferable to optimize the system to achieve good noise cancellation performance over the lower part of the audio frequency range, for example from 80 Hz to 2.5 kHz. It is therefore sufficient to generate a control signal having a sample rate which is twice the frequency above which it is not expected to achieve outstanding noise cancellation performance.

In the illustrated embodiment of the invention, the control signal has a sampling rate of 8 kHz, but, in other embodiments of the invention, the control signal may have a sampling rate which is less then 2 kHz, or less than 10 kHz, or less than 20 kHz, or less than 50 kHz.

In the illustrated embodiment of the invention, the decimator 52 reduces the sample rate of the digital signal from 2.4 MHz to 8 kHz, and the microprocessor 54 produces a control signal at the same sampling rate as its input signal. However, the microprocessor 54 can in principle produce a control signal having a sampling rate that is higher, or lower, than its input signal received from the decimator 52.

The illustrated embodiment shows the noise signal being received from an analog source, such as a microphone, and being converted to digital form in an analog-digital converter 42 in the signal processing circuitry. However, it will be appreciated that the noise signal could be received in a digital form, from a digital microphone, for example.

Further, the illustrated embodiment shows the noise cancellation signal being generated in a digital form, and being converted to analog form in a digital-analog converter 50 in the signal processing circuitry. However, it will be appreciated that the noise cancellation signal could be output in a digital form, for example for application to a digital speaker, or the like.

In one embodiment of the invention, the IIR filter 80 has a filter characteristic which preferentially passes signals at relatively low frequencies. For example, although the noise cancellation system may seek to cancel ambient noise as far as possible across the whole of the audio frequency band, the particular arrangement of the microphones 20, 22, and the speaker 28, and the size and shape of the earphone 10, may mean that it is preferred for the IIR filter 80 to have a filter characteristic which boosts signals at frequencies in the 250-750 Hz region. However, in other embodiments, the IIR filter 80 may have a significant boost below 250 Hz as well. This boost may be needed to compensate for small speakers mounted in small enclosures, which generally have a poor low-frequency response.

However, this means that, when there is an ambient noise signal having a large component within this frequency range, there is a danger that the noise signal generated by the filter 80 will be larger than the speaker 28 can comfortably handle without distortion, etc, i.e. the speaker 28 may be overdriven. Should this occur, the speaker cone may move beyond its excursion limit, resulting in physical damage to the speaker.

Therefore, in order to prevent this, the frequency characteristic of the adaptive high-pass filter 82 is adapted, based on the amplitude of the input signal. In fact, in this preferred embodiment, the frequency characteristic of the adaptive high-pass filter 82 is adapted, based on the output signal from the emulated filter 56. Moreover, in this preferred embodiment, the frequency characteristic of the adaptive high-pass filter 82 is adapted, based on the sum of the wanted signal from the second input 49 and the output signal from the emulated filter 56. This means that the frequency characteristic of the adaptive high-pass filter 82 is adapted based on a representation of the signal that would actually be applied to the speaker 28.

More specifically, in this illustrated embodiment of the invention, the adaptive high-pass filter 82 is a first-order high pass filter, with a cut-off frequency, or corner frequency, which can be adjusted based on the control signal applied from the microprocessor 54. The filter 82 has a generally constant gain, which may be unity or may be some other value provided that there is suitable compensation elsewhere in the filter path, at frequencies above the corner frequency, and has a gain that reduces below that corner frequency.

In one embodiment, the corner frequency may be adjustable in the range from 10 Hz to 1.4 kHz.

Figure 3:
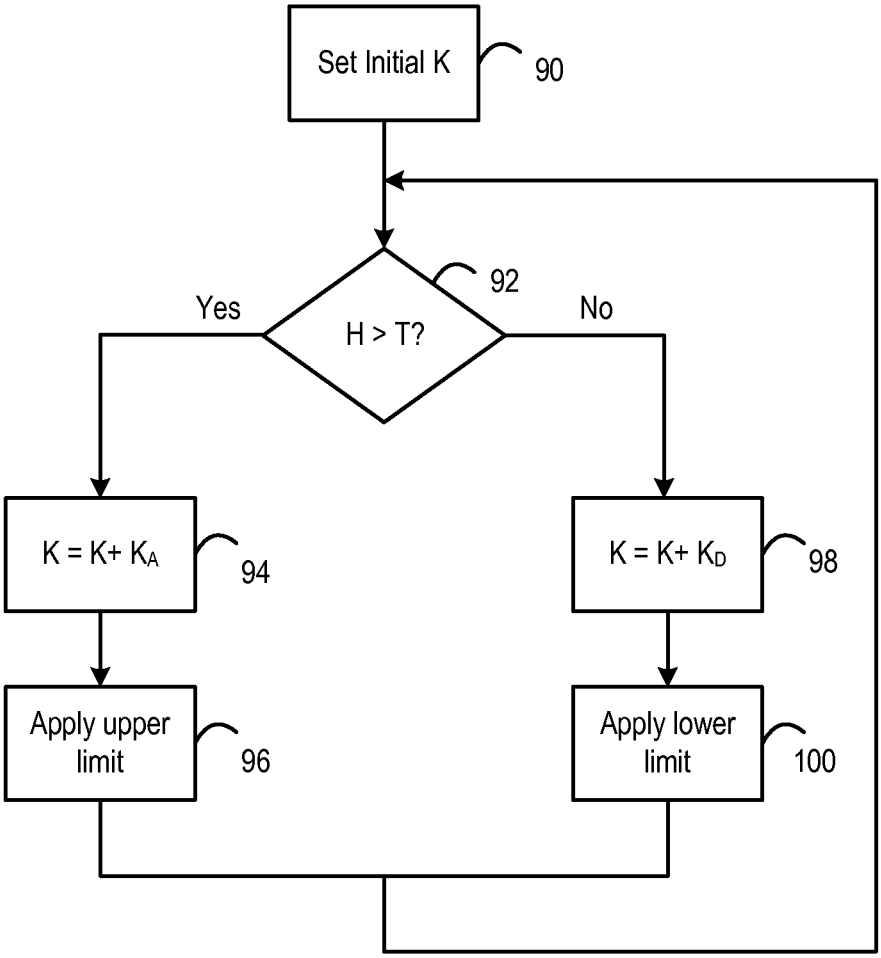
FIG. 3 is a flow chart, illustrating a process in accordance with an aspect of the invention.

FIG. 3 is a flow chart, illustrating the process performed in the control block 60.

In step 90, the process is initialized, by setting an initial value for a control value K, which is used to control the corner frequency of the high pass filter 82.

In step 92, the input value to the control block 60, namely the absolute value of the sum H of the emulated filter block 56 and the wanted source input 49, is compared with a threshold value T. If the sum H exceeds the threshold value T, the process passes to step 94, in which an attack coefficient $K_A$ is added to the current control value K. After adding these values together, it is tested in step 96 whether the new control value exceeds an upper limit value and, if so, this upper limit value is applied instead. If the new control value does not exceed the upper limit value, the new control value is used.

If in step 92 the absolute value of the sum H is lower than the threshold value T, the process passes to step 98, in which a decay coefficient $K_D$ is added to the current control value K. It should be noted that the decay coefficient $K_D$ is negative, and so adding it to the current control value K reduces that value. After adding these values together, it is tested in step 100 whether the new control value falls below a lower limit value and, if so, this lower limit value is applied instead. If the new control value does not fall below the lower limit value, the new control value is used.

When the new control value has been determined, the process returns to step 92, where the new sum H of the emulated filter block 56 and the wanted source input 49 is compared with the threshold value T.

In one embodiment, the attack coefficient $K_A$ is larger in magnitude that the decay coefficient $K_D$, so that if a transient low frequency signal occurs, the cut-off frequency can be increased rapidly, resulting in a fast reduction in output amplitude to prevent the speaker exceeding its excursion limit. Further, a relatively smaller decay coefficient minimizes any ripple in the cut-off frequency, so that the cut-off frequency effectively tracks the envelope of the input signal, rather than the absolute value.

Further, it will be apparent to those skilled in the art that other implementations of the control algorithm performed in control block 60 are possible, in order to alter the cut-off frequency appropriately to prevent speaker overload. For example, the attack and decay coefficients $K_A$ and $K_D$ could be varied in a non-linear (e.g. exponential) way.

As described above, the control process is performed at a lower sample rate than the sample rate of the input digital signal. In order to ensure that this is not a source of errors, the control value is passed through a frequency warping function 62.

Further, the control value is passed through a smoothing filter 64, which is provided to smooth any unwanted ripple in the signal. In this embodiment, the filter determines whether the control value is increasing or decreasing. If the control value is increasing, the output of the filter 64 tracks the input directly, without any time lag. However, if the control value is decreasing, the output of the filter 64 decays exponentially towards the input, in order to smooth any unwanted ripple in the output signal.

The output of the smoothing filter 64 is passed to sample-and-hold circuitry 66, from which it is latched out to the adaptive filter 82. The corner frequency of the filter 82 is then determined by the filtered control value applied to the filter. For example, when the control value takes the lower limit value, the corner frequency can take its minimum value, of 10 Hz in the illustrated embodiment, while, when the control value takes the upper limit value, the corner frequency can take its maximum value, namely 1.4 kHz in the illustrated embodiment.

It will be apparent to those skilled in the art that the present invention is equally applicable to so-called feedback noise cancellation systems.

The feedback method is based upon the use, inside the cavity that is formed between the ear and the inside of an earphone shell, or between the ear and a mobile phone, of a microphone placed directly in front of the loudspeaker. Signals derived from the microphone are coupled back to the loudspeaker via a negative feedback loop (an inverting amplifier), such that it forms a servo system in which the loudspeaker is constantly attempting to create a null sound pressure level at the microphone.

Figure 4:
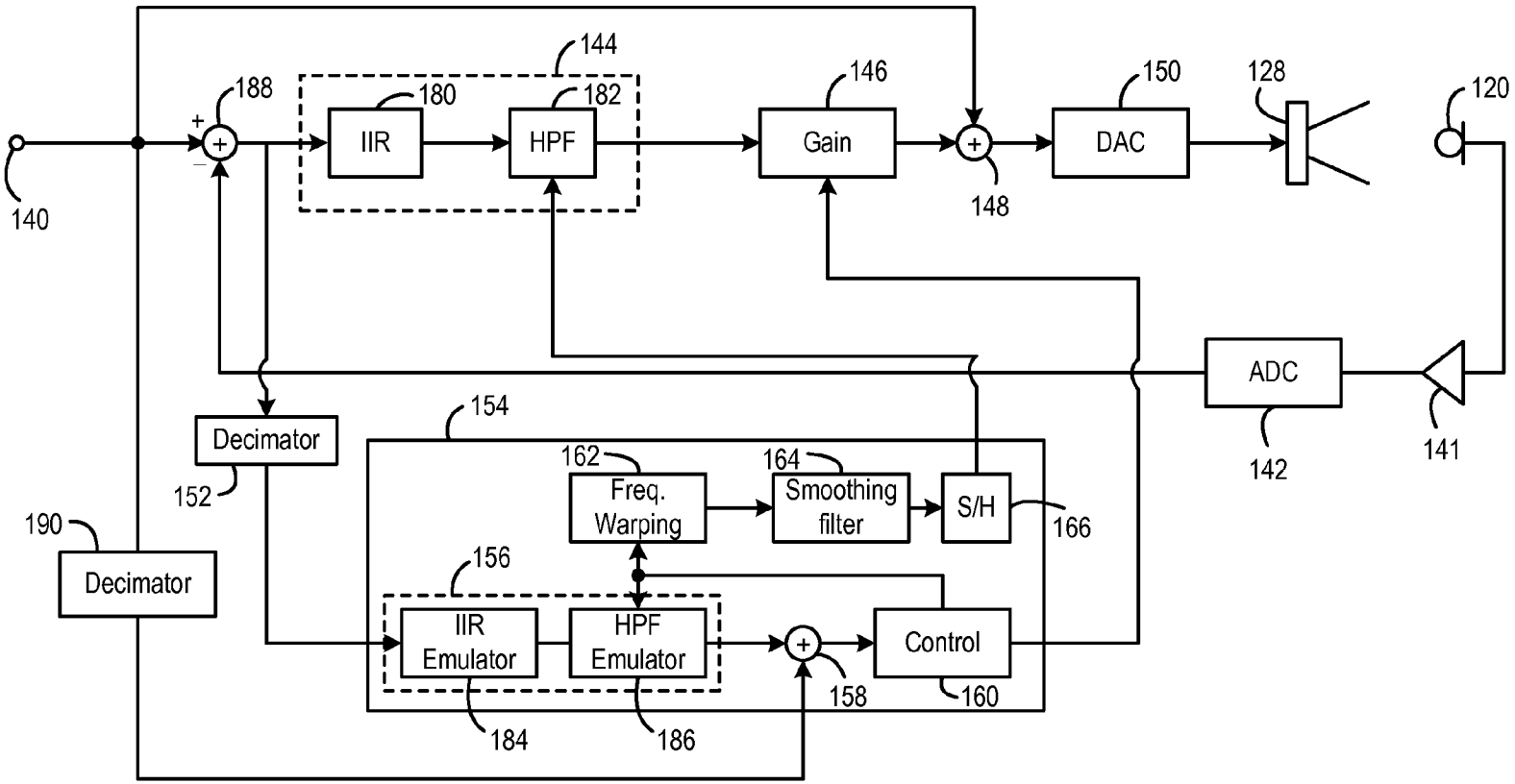
FIG. 4 illustrates a signal processing circuit in accordance with the present invention when embodied in a feedback noise cancellation system.

FIG. 4 shows an example of signal processing circuitry according to the present invention when implemented in a feedback system.

The feedback system comprises a microphone 120 positioned substantially in front of a loudspeaker 128. The microphone 120 detects the output of the loudspeaker 128, with the detected signal being fed back via an amplifier 141 and an analog-to-digital converter 142. A wanted audio signal is fed to the processing circuitry via an input 140. The fed back signal is subtracted from the wanted audio signal in a subtracting element 188, in order that the output of the subtracting element 188 substantially represents the ambient noise, i.e. the wanted audio signal has been substantially cancelled.

Thereafter, the processing circuitry is substantially similar to the processing circuitry 24 in the feed forward system described with respect to FIG. 2. The output of the subtracting element 188 is fed to an adaptive digital filter 144, and the filtered signal is applied to an adaptable gain device 146.

The resulting signal is applied to an adder 148, where it is summed with the wanted audio signal received from the input 140.

Thus, the filtering and level adjustment applied by the filter 144 and the gain device 146 are intended to generate a noise cancellation signal that allows the detected ambient noise to be cancelled.

The output of the adder 148 is applied to a digital-analog converter 150, so that it can be passed to the loudspeaker 128.

As mentioned above, the noise cancellation signal is produced from the input signal by the adaptive digital filter 144 and the adaptable gain device 146. These are controlled by a control signal, which is generated by applying the digital signal output from the analog-digital converter 142 to a decimator 152 which reduces the digital sample rate, and then to a microprocessor 154.

The microprocessor 154 contains a block 156 that emulates the filter 144 and gain device 146, and produces an emulated filter output which is applied to an adder 158, where it is summed with the wanted audio signal from the input 140 via a decimator 190.

The resulting signal is applied to a control block 160, which generates control signals for adjusting the properties of the filter 144 and the gain device 146. The control signal for the filter 144 is applied through a frequency warping block 162, a smoothing filter 164 and sample-and-hold circuitry 166 to the filter 144. The same control signal is also applied to the block 156, so that the emulation of the filter 144 matches the adaptation of the filter 144 itself.

In an alternative embodiment, the sample-and-hold circuitry 166 is replaced by an interpolation filter.

The control block 160 further generates a control signal for the adaptive gain device 146. In the illustrated embodiment, the gain control signal is output directly to the gain device 146.

Further, the microprocessor 154 may comprise an adaptive gain emulator (not shown in FIG. 3), located in between the filter emulator 156 and the adder 158. In this instance, the control block 160 will also output the gain control signal to the adaptive gain emulator.

Similarly to the feedforward case, the fixed filter 180 may be an IIR filter, and the adaptive filter 182 may be a high pass filter.

According to another aspect of the present invention, the signal processor 24 includes means for measuring the level of ambient noise and for controlling the addition of the noise cancellation signal to the source signal based on the level of ambient noise. For example, in environments where ambient noise is low or negligible, noise cancellation may not improve the sound quality heard by the user. That is, the noise cancellation may even add artefacts to the sound stream to correct for ambient noise that is not present. Further, the activity of the noise cancellation system during such periods consumes power that is wasted. Therefore, when the noise signal is low, the noise cancellation signal may be reduced, or even turned off altogether. This saves power and prevents the noise signal from adding unwanted noise to the voice signal.

However, when the noise cancellation system is present in a mobile phone or headset, for example, the ambient noise may be detected in isolation from the user's own voice. That is, a user may be speaking on a mobile phone or headset in an otherwise empty room, but the noise cancellation system may still not detect that noise is low due to the user's voice.

Figure 5:
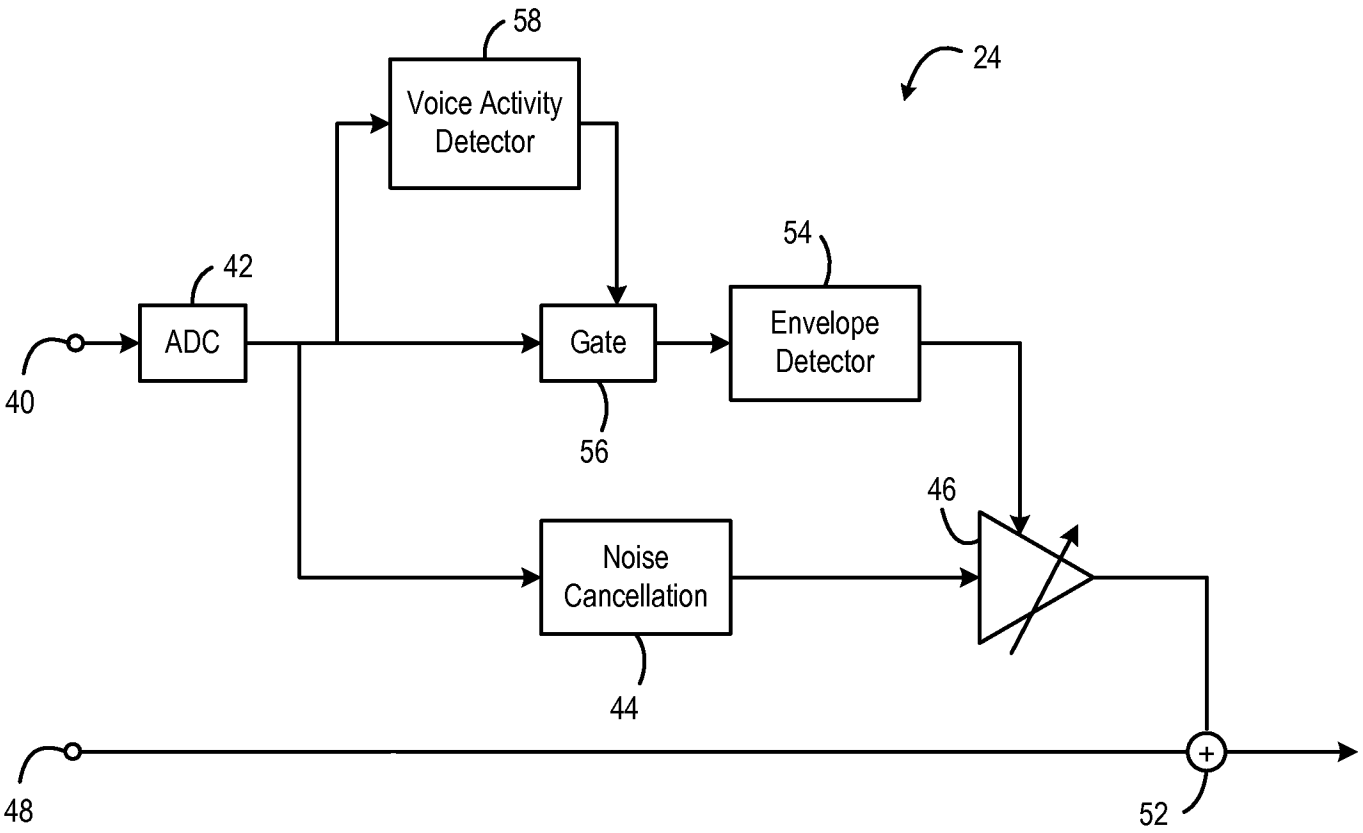
FIG. 5 illustrates a further signal processing circuit in accordance with an aspect of the invention in the noise cancellation system of FIG. 1.

FIG. 5 shows in more detail a further embodiment of the signal processing circuitry 24. An input 40 is connected to receive a noise signal, for example directly from the microphones 20, 22, representative of the ambient noise. The noise signal is input to an analogue-to-digital converter (ADC) 42, and is converted to a digital noise signal. The digital noise signal is input to a noise cancellation block 44, which outputs a noise cancellation signal. The noise cancellation block 44 may for example comprise a filter for generating a noise cancellation signal from a detected ambient noise signal, i.e. the noise cancellation block 44 substantially generates the inverse signal of the detected ambient noise. The filter may be adaptive or non-adaptive, as will be apparent to those skilled in the art.

The noise cancellation signal is output to a variable gain block 46. The control of the variable gain block 46 will be explained later. Conventionally, a gain block may apply gain to the noise cancellation signal in order to generate a noise cancellation signal that more accurately cancels the detected ambient noise. Thus, the noise cancellation block 44 will typically comprise a gain block (not shown) designed to operate in this manner. However, according to one embodiment of the present invention the applied gain is varied according to the detected amplitude, or envelope, of ambient noise. The variable gain block 46 may therefore be in addition to a conventional gain block present in the noise cancellation block 44, or may represent the gain block in the noise cancellation block 44 itself, adapted to implement the present invention.

The signal processor 24 further comprises an input 48 for receiving a voice or other wanted signal, as described above. Thus, in the case of a mobile phone, the wanted signal is the signal that has been transmitted to the phone, and is to be converted to an audible sound by means of the speaker 28. In general, the wanted signal will be digital (e.g. music, a received voice, etc), in which case the wanted signal is added to the noise cancellation signal output from the variable gain block 46 in an adding element 52. However, in the case that the wanted signal is analogue, the wanted signal is input to an ADC (not shown), where it is converted to a digital signal, and then added in the adding element 52. The combined signal is then output from the signal processor 24 to the loudspeaker 28.

Figure 6:
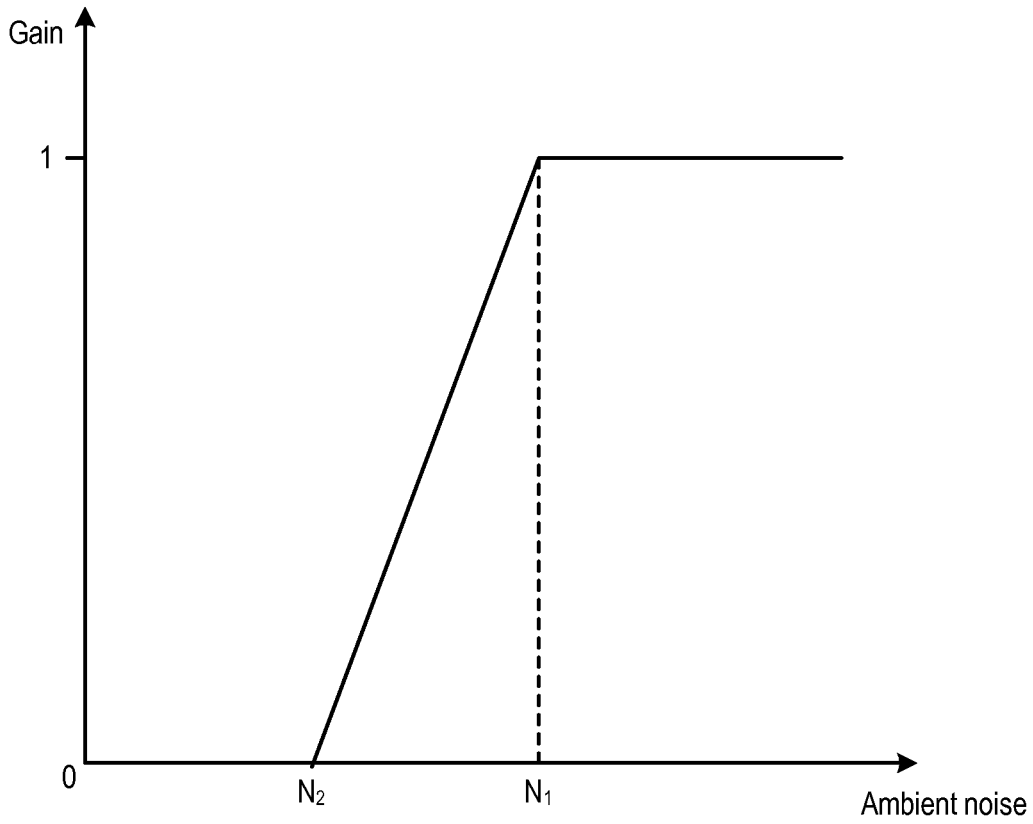
FIG. 6 is a schematic graph showing one embodiment of the variation of applied gain with the detected noise envelope.

Further, according to the present invention, the digital noise signal is input to an envelope detector 54, which detects the envelope of the ambient noise and outputs a control signal to the variable gain block 46. FIG. 6 shows one embodiment, where the envelope detector 54 compares the envelope of the noise signal to a threshold value $N_1$, and outputs the control signal based on the comparison. For example, if the envelope of the noise signal is below the threshold value $N_1$, the envelope detector 54 may output a control signal such that zero gain is applied, effectively turning off the noise cancellation function of the system 10. Similarly, the envelope detector 54 may output a control signal to actually turn off the noise cancellation function of the system 10. In the illustrated embodiment, if the envelope of the noise signal is below the first threshold value $N_1$, the envelope detector 54 outputs a control signal such that the gain is gradually reduced with decreasing noise such that, when a second, lower, threshold value $N_2$ is reached, zero gain is applied. In between the threshold values $N_1$ and $N_2$, the gain is varied linearly; however, a person skilled in the art will appreciate that the gain may be varied in a stepwise manner, or exponentially, for example.

Figure 7:
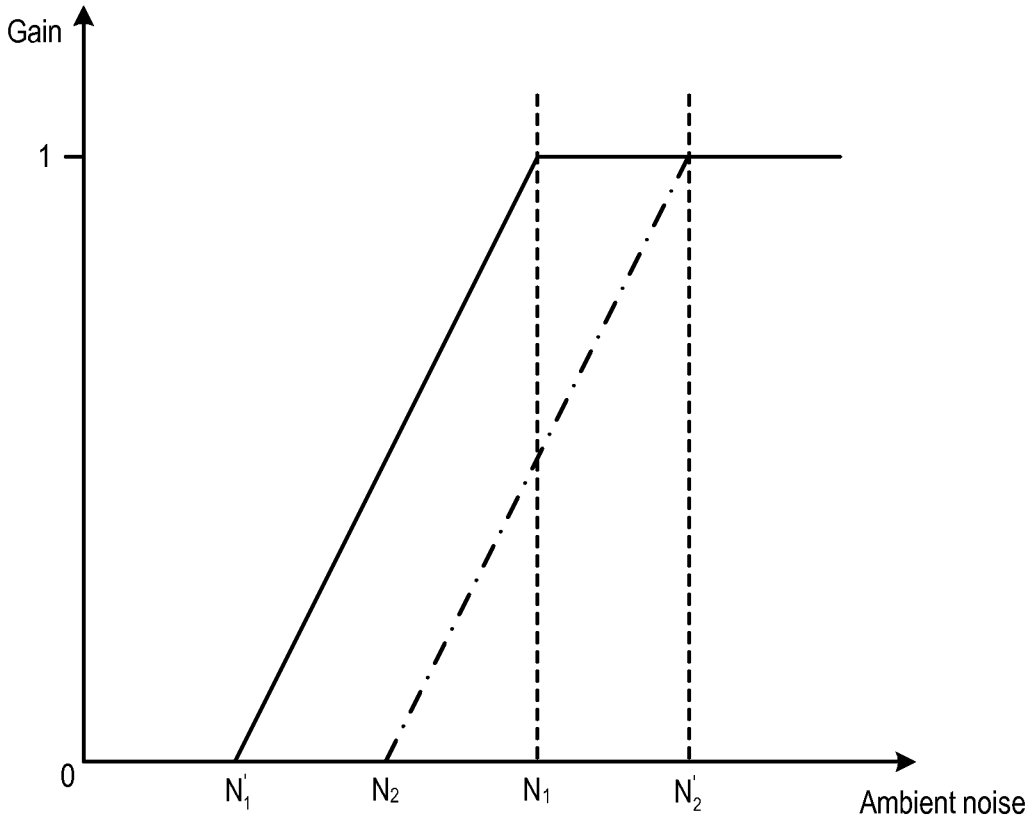
FIG. 7 is a schematic graph showing another embodiment of the variation of applied gain with the detected noise envelope.

FIG. 7 shows a schematic graph of a further embodiment, in which the envelope detector 54 employs a first threshold value $N_1$ and a second threshold value $N_2$ in such a way that a hysteresis is built into the system. The solid line of the graph represents the applied gain when the system is transitioning from a "full" noise cancellation signal to a zero noise cancellation signal; and the chain line represents the applied gain when the system is transitioning from a zero noise cancellation signal to a full noise cancellation signal. In the illustrated embodiment, when the system is initially generating a full noise cancellation signal, but the ambient noise then falls below the first threshold $N_1$, the applied gain is reduced until zero gain is applied at a value $N_1'$ of ambient noise. When the system is initially switched off, or generating a "zero" noise cancellation signal, and the envelope of the ambient noise rises above the second threshold value $N_2$, the applied gain is increased until a full noise cancellation signal is generated at a value $N_2'$ of ambient noise. The second threshold value may be set higher than the value $N_1'$, at which value the noise cancellation was previously switched off, such that a hysteresis is built into the system. The hysteresis prevents rapid fluctuations between noise cancellation "on" and "off" states when the envelope of the noise signal is close to the first threshold value.

A person skilled in the art will appreciate that rather than gradually reducing or increasing the applied gain, the noise cancellation may be switched off or on when the ambient noise crosses the first and second thresholds, respectively. However, in this embodiment the envelope detector 54 of the signal processor 24 may comprise a ramping filter to smooth transitions between different levels of gain. Harsh transitions may sound strange to the user, and by choosing an appropriate time constant for the ramping filter, they can be avoided.

Although in the description above an envelope detector is used to determine the level of ambient noise, alternatively the amplitude of the noise signal may be used instead. The term "noise level", also used in the description, may apply to the amplitude or envelope, or some other magnitude of the noise signal.

Of course, there are many possible alternative methods, not explicitly mentioned here, of altering the addition of the noise cancellation signal to the wanted signal in accordance with the detected ambient noise that would be apparent to those skilled in the art. The present invention is not limited to any one of the described methods, except as defined in the claims appended hereto.

According to a further embodiment of the invention, the digital noise signal output from the ADC 42 is input to the envelope detector 52 via a gate 56. The gate 56 is controlled by a voice activity detector (VAD) 58, which also receives the digital noise signal output from the ADC 42. The VAD 58 then operates the gate 56 such that the noise signal is allowed through to the envelope detector 52 only during voiceless periods. The operation of the gate 56 and the VAD 58 will be described in greater detail below. The VAD 58 and gate 56 are especially beneficial when the noise cancellation system 10 is realized in a mobile phone, or a headset, i.e. any system where the user is liable to be speaking whilst using the system.

The use of a voice activity detector is advantageous because the system includes one or more microphones 20, 22 which detect ambient noise, but which are also close enough to detect the user's own speech. When it is determined that the gain of the noise cancellation system should be controlled on the basis of the ambient noise, it is advantageous to be able to detect the ambient noise level during periods when the user is not speaking.

In the illustrated embodiment of the invention, the ambient noise level is taken to be the noise level during the quietest period within a longer period. Thus, in one embodiment, where the signal from the microphones 20, 22 is converted to a digital signal at a sample rate of 8 kHz, the digital samples are divided into frames, each comprising 256 samples, and the average signal magnitude is determined for each frame. Then, the ambient noise level at any time is determined to be the frame, from amongst the most recent 32 frames, having the lowest average signal magnitude.

Thus, it is assumed that, in each period of 32×256 samples (=approximately 1 second), there will be one frame where the user will not be making any sound, and the detected signal level during this frame will accurately represent the ambient noise.

The gain applied to the noise cancellation signal is then controlled based on ambient noise level determined in this manner. Of course, however, many methods are known for detecting voice activity, and the invention is not limited to any particular method, except as defined in the claims as appended hereto.

Various modifications may be made to the embodiments described above without departing from the scope of the claims appended hereto. For example, a digital noise signal may be input directly to the signal processor 28, and in this case the signal processor 28 would not comprise ADC 42. Further, the VAD 58 may receive an analogue version of the noise signal, rather than the digital signal.

The present invention may be employed in feedforward noise cancellation systems, as described above, or in so-called feedback noise cancellation systems. The general principle of adapting the addition of the noise cancellation signal to the wanted signal in accordance with the detected ambient noise level is applicable to both systems.

Figure 8:
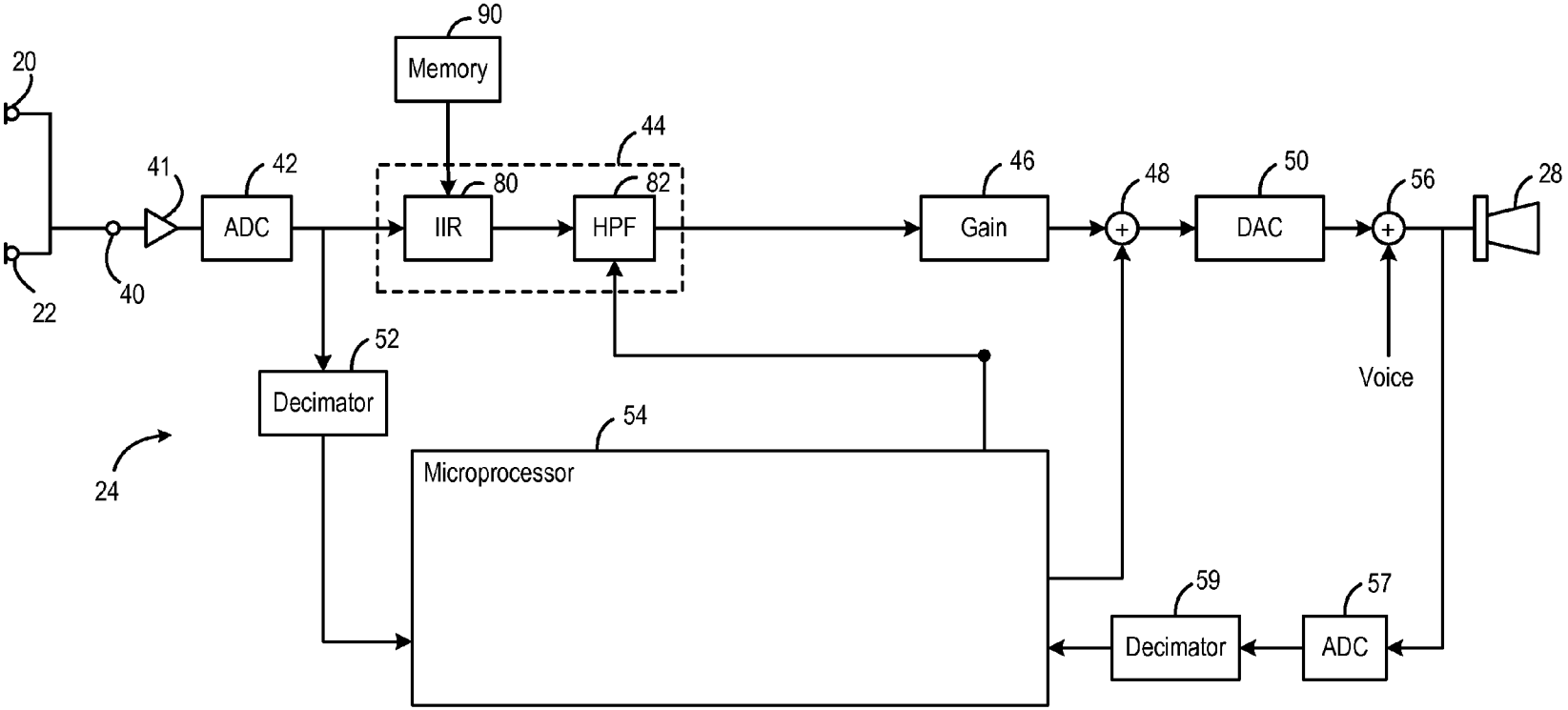
FIG. 8 illustrates a signal processing circuit in accordance with another aspect of the invention in the noise cancellation system of FIG. 1.

FIG. 8 shows in more detail a further embodiment of the signal processing circuitry 24. An input 40 is connected to receive an input signal, for example directly from the microphones 20, 22. This input signal is amplified in an amplifier 41 and the amplified signal is applied to an analog-digital converter 42, where it is converted to a digital signal. The digital signal is applied to an adaptive digital filter 44, and the filtered signal is applied to an adaptable gain device 46. Those skilled in the art will appreciate that in the case where the microphones 20, 22 are digital microphones, wherein an analog-digital converter is incorporated into the microphone capsule and the input 40 receives a digital input signal, the analog-digital converter 42 is not required.

The resulting signal is applied to a first input of an adder 48, the output of which is applied to a digital-analog converter 50. The output of the digital-analog converter 50 is applied to a first input of a second adder 56, the second input of which receives a wanted signal from the source 26. The output of the second adder 56 is passed to the loudspeaker 28. Those skilled in the art will further appreciate that the wanted signal may be input to the system in digital form. In this instance, the adder 56 may be located prior to the digital-analog converter 50, and thus the combined signal output from the adder 56 is converted to analog before being output through the speaker 28.

Thus, the filtering and level adjustment applied by the filter 44 and the gain device 46 are intended to generate a noise cancellation signal that allows the detected ambient noise to be cancelled.

As mentioned above, the noise cancellation signal is produced from the input signal by the adaptive digital filter 44 and the adaptive gain device 46. These are controlled by a control signal, which is generated by applying the digital signal output from the analog-digital converter 42 to a decimator 52 which reduces the digital sample rate, and then to a microprocessor 54.

In this illustrated embodiment of the invention, the adaptive filter 44 is made up a first filter stage 80, in the form of a fixed IIR filter 80, and a second filter stage, in the form of an adaptive high-pass filter 82.

The microprocessor 54 generates a control signal, which is applied to the adaptive high-pass filter 82 in order to adjust a corner frequency thereof. The microprocessor 54 generates the control signal on an adaptive basis in use of the noise cancellation system, so that the properties of the filter 44 can be adjusted based on the properties of the detected noise signal.

However, the invention is equally applicable to systems in which the filter 44 is fixed. In this context, the word "fixed" means that the characteristic of the filter is not adjusted on the basis of the detected noise signal.

However, the characteristic of the filter 44 can be adjusted in a calibration phase, which may for example take place when the system 24 is manufactured, or when it is first integrated with the microphones 20, 22 and speaker 28 in a complete device, or whenever the system is powered on, or at other irregular intervals.

More specifically, the characteristic of the fixed IIR filter 80 can be adjusted in this calibration phase by downloading to the filter 80 a replacement set of filter coefficients, from multiple sets of coefficients stored in a memory 90.

Further, the gain applied by the adjustable gain element 46 can similarly be adjusted in the calibration phase. Alternatively, a change in the gain can be achieved during the calibration phase by suitable adjustment of the characteristic of the fixed IIR filter 80.

In this way, the signal processing circuitry 24 can be optimized for the specific device with which it is to be used.

Figure 9:
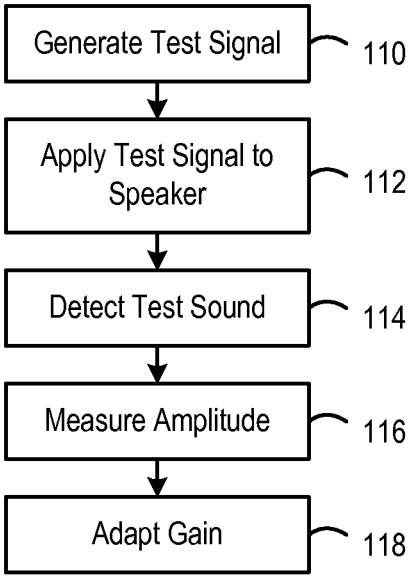
FIG. 9 is a flow chart, illustrating a method of calibrating a noise cancellation system in accordance with an aspect of the invention.

FIG. 9 is a flow chart, illustrating a method in accordance with an aspect of the invention. As mentioned above, the signal processing circuitry needs to generate a noise cancellation signal that, when applied to the speaker 28, produces a sound that cancels as far as possible the ambient noise heard by the user. The amplitude of the noise cancellation signal that produces this effect will depend on the sensitivity of the microphones 20, 22 and of the speaker 28, and on the degree of coupling from the speaker 28 to the microphones 20, 22 (for example, how close is the speaker 28 to the microphones 20, 22?), although this can be assumed to be equal for all devices (such as mobile phones) of the same model. The method proceeds from the recognition that, although these two parameters cannot easily be measured, what is actually important is their product. The method in accordance with the invention therefore consists of applying a test signal, of known amplitude, to the speaker 28 and detecting the resulting sound with the microphones 20, 22. The amplitude of the detected signal is a measure of the product of the sensitivity of the microphones 20, 22 and that of the speaker 28.

In step 110, a test signal is generated in the microprocessor 54. In one embodiment of the invention, the test signal is a digital representation of a sinusoidal signal at a known frequency. As discussed above, the aim of this calibration process is to compensate for the differences between devices, even though these devices are nominally the same. For example, in a mobile phone or similar device, the gain of the microphone may be 3 dB more or less than its nominal value. Similarly, the gain of the speaker may be 3 dB more or less than its nominal value, with the result that the product of these two may be 6 dB more or less than its nominal value. In addition, the speaker will typically have a resonant frequency, somewhere within the audio frequency range. It will be appreciated that making measurements of the relative gains of two speakers will give misleading results, if one measurement is made at the resonant frequency of the speaker and the other measurement is made away from the resonant frequency of that speaker, and that, if the two speakers have different resonant frequencies, this situation may arise even if the gain measurements are made at the same frequency.

Therefore, the test signal preferably comprises a digital representation of a sinusoidal signal at a known frequency, where that known frequency is well away from any expected resonant frequency of the speaker, and hence such that all devices of the same class are expected to have generally similar properties, except for the general sensitivities of their microphones and speakers.

In alternative embodiments, the test signal may be a band-limited noise signal, ir a pseudo-random data-pattern such as a maximum-length sequence.

In step 112, the test signal is applied from the microprocessor 54 to the second input of the adder 48, and thus applied to the speaker 28.

In step 114, the resulting sound signal is detected by the microphones 20, 22, and a portion of the detected signal is passed to the microprocessor 54.

In step 116, the microprocessor 54 measures the amplitude of the detected signal. This can be done in different ways. For example, the total amplitude of the detected signal may be measured, but this will result in the detection not only of the test sound, but also of any ambient noise. Alternatively, the detected sound signal can be filtered, and the amplitude of the filtered sound signal detected. For example the detected sound signal can be passed through a digital Fourier transform, allowing the component of the sound signal at the frequency of the test signal to be separated out, and its amplitude measured. As a further alternative, the test signal can contain a data pattern, and the microprocessor 54 can be used to detect the correlation between the detected sound signal and the test signal, so that the detected amplitude can be determined to be the amplitude that results from the test signal, rather than from ambient noise.

In step 118, the signal processor is adapted based on the detected amplitude. For example, the gain of the adaptive gain element 46 can be adjusted.

The signal processing circuitry 24 is intended for use in a wide range of devices. However, it is anticipated that large numbers of devices containing the signal processing circuitry 24 will be manufactured, with each one being included in a larger device containing the microphones 20, 22 and the speaker 28. Although these larger devices will be nominally identical, every microphone and every speaker may be slightly different. The present invention proceeds from the recognition that one of the more significant of these differences will be differences in the resonant frequency of the speaker 28 from one device to another. The invention further proceeds from the recognition that the resonant frequency of the speaker 28 may vary in use of the device, as the temperature of the speaker coil varies. However, other causes of resonant frequency variation are possible, including ageing, or changing humidity, etc. The present invention is equally applicable in all such cases.

Figure 10:
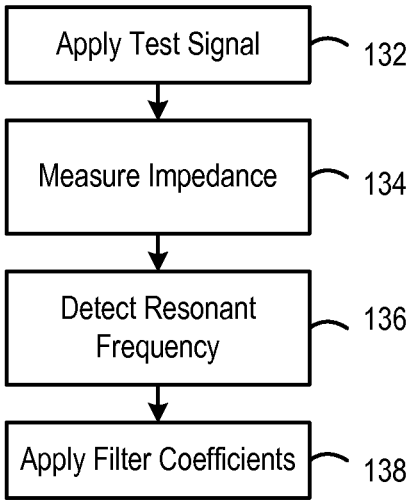
FIG. 10 is a flow chart, illustrating a method of calibrating a noise cancellation system in accordance with another aspect of the invention.

FIG. 10 is a flow chart, illustrating a method in accordance with the invention. In step 132, a test signal is generated by the microprocessor 54, and applied to the second input of the adder 48. In one embodiment, the test signal is a concatenation of sinusoid signals at a plurality of frequencies. These frequencies cover a frequency range in which the resonant frequency of the speaker 28 is expected to lie.

In step 134, the impedance of the speaker is determined. That is, based on the applied test signal, the current flowing through the speaker coil is measured. For example, the current in the speaker coil may be detected, and passed through an analog-digital converter 57 and decimator 59 to the microprocessor 54. Conveniently, the microprocessor may determine the impedance at each frequency by applying the detected current signal to a digital Fourier transform block (not illustrated) and measuring the magnitude of the current waveform at each frequency. Alternatively, signals at different frequencies can be detected by appropriately adjusting the rate at which samples are generated by the decimator 59.

In step 136 of the process, the resonant frequency is determined, being the frequency at which the current is a minimum, and hence the impedance is a maximum, within a frequency band which spans the range of possible resonant frequencies.

In step 138, the frequency characteristic of the filter 44 is adjusted, based on the detected resonant frequency. In one embodiment, the memory 90 stores a plurality of sets of filter coefficients, with each set of filter coefficients defining an IIR filter having a characteristic that contains a peak at a particular frequency. These particular frequencies can advantageously be the same as the frequencies of the sinusoid signals making up the test signal. In this case, it is advantageous to apply to the adaptive IIR filter a set of coefficients defining a filter that has a peak at the detected resonant frequency.

In one embodiment of the invention, the sets of filter coefficients each define sixth order filters, with the resonant frequencies of these filter characteristics being the most substantial difference between them.

It is thus possible to detect the resonant frequency of the speaker, and select a filter which has a characteristic that matches this most closely.

In embodiments of the invention, the microprocessor 54 may contain an emulation of the filter 44, in order to allow adaptation of the filter characteristics of the filter 44 based on the detected noise signal. In this case, any filter characteristic that is applied to the filter 44 should preferably also be applied to the filter emulation in the microprocessor 54.

The invention has been described so far with reference to an embodiment in which one of a plurality of prestored sets of filter coefficients is applied to the filter. However, it is equally possible to calculate the required filter coefficients based on the detected resonant frequency and any other desired properties.

In one embodiment of the invention, this calibration process is performed when the signal processing circuitry 24 is first included in the larger device containing the microphones 20, 22 and the speaker 28, or when the device is first powered on, for example.

In addition, it has been noted that the resonant frequency of a speaker can change with temperature, for example as the temperature of the speaker coil increases with use of the device. It is therefore advantageous to perform this calibration in use of the device or after a period of use.

If it is desired to perform the calibration while the device is in use, the useful signal (i.e.

the sum of the wanted signal and the noise cancellation signal) through the speaker 28 (for example during a call in the case where the device is a mobile phone) can be used as the test signal.

It will be apparent to those skilled in the art that the present invention is equally applicable to so-called feedback noise cancellation systems.

The feedback method is based upon the use, inside the cavity that is formed between the ear and the inside of an earphone shell, or between the ear and a mobile phone, of a microphone placed directly in front of the loudspeaker. Signals derived from the microphone are coupled back to the loudspeaker via a negative feedback loop (an inverting amplifier), such that it forms a servo system in which the loudspeaker is constantly attempting to create a null sound pressure level at the microphone.

Figure 11:
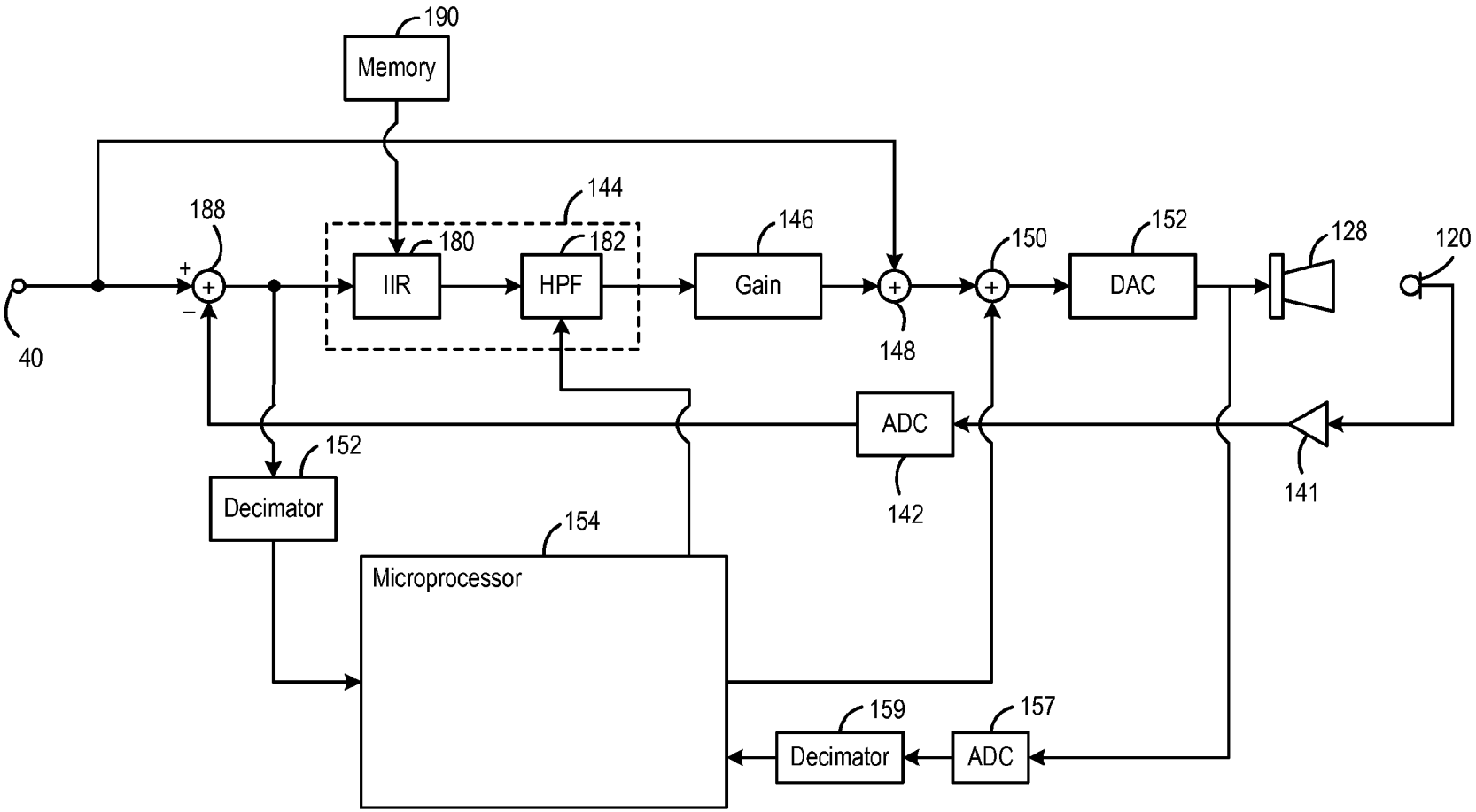
FIG. 11 illustrates a signal processing circuit in accordance with the present invention as described with respect to FIG. 8, when embodied in a feedback noise cancellation system.

FIG. 11 shows an example of signal processing circuitry according to the present invention as described with respect to FIG. 8, when implemented in a feedback system.

The feedback system comprises a microphone 120 positioned substantially in front of a loudspeaker 128. The microphone 120 detects the output of the loudspeaker 128, with the detected signal being fed back via an amplifier 141 and an analog-to-digital converter 142. A wanted audio signal is fed to the processing circuitry via an input 140. The fed back signal is subtracted from the wanted audio signal in a subtracting element 188, in order that the output of the subtracting element 188 substantially represents the ambient noise, i.e. the wanted audio signal has been substantially cancelled.

Thereafter, the processing circuitry is substantially similar to that in the feed forward system described with respect to FIG. 8. The output of the subtracting element 188 is fed to an adaptive digital filter 144, and the filtered signal is applied to an adaptable gain device 146.

The resulting signal is applied to an adder 148, where it is summed with the wanted audio signal received from the input 140.

Thus, the filtering and level adjustment applied by the filter 144 and the gain device 146 are intended to generate a noise cancellation signal that allows the detected ambient noise to be cancelled.

As mentioned above, the noise cancellation signal is produced by the adaptive digital filter 144 and the adaptive gain device 146. These are controlled by a control signal, which is generated by applying the signal output from the subtracting element 188 to a decimator 152 which reduces the digital sample rate, and then to a microprocessor 154.

In this illustrated embodiment of the invention, the adaptive filter 144 is made up a first filter stage 180, in the form of a fixed IIR filter 180, and a second filter stage, in the form of an adaptive high-pass filter 182.

The microprocessor 154 generates a control signal, which is applied to the adaptive high-pass filter 182 in order to adjust a corner frequency thereof. The microprocessor 54 generates the control signal on an adaptive basis in use of the noise cancellation system, so that the properties of the filter 144 can be adjusted based on the properties of the detected noise signal.

However, the invention is equally applicable to systems in which the filter 144 is fixed. In this context, the word "fixed" means that the characteristic of the filter is not adjusted on the basis of the detected noise signal.

However, the characteristic of the filter 144 can be adjusted in a calibration phase, which may for example take place when the system is manufactured, or when it is first integrated with the microphones 120 and speaker 128 in a complete device, or whenever the system is powered on, or at other irregular intervals.

More specifically, the characteristic of the fixed IIR filter 180 can be adjusted in this calibration phase by downloading to the filter 180 a replacement set of filter coefficients, from multiple sets of coefficients stored in a memory 190.

Further, the gain applied by the adjustable gain element 146 can similarly be adjusted in the calibration phase. Alternatively, a change in the gain can be achieved during the calibration phase by suitable adjustment of the characteristic of the fixed IIR filter 180.

In this way, the signal processing circuitry can be optimized for the specific device with which it is to be used.

The microprocessor 154 further generates a test signal, as described previously, and outputs the test signal to an adding element 150, where it is added to the signal output from the adding element 148. The combined signal is then output to a digital-analog converter 152, and output through a speaker 128.

Figure 12:
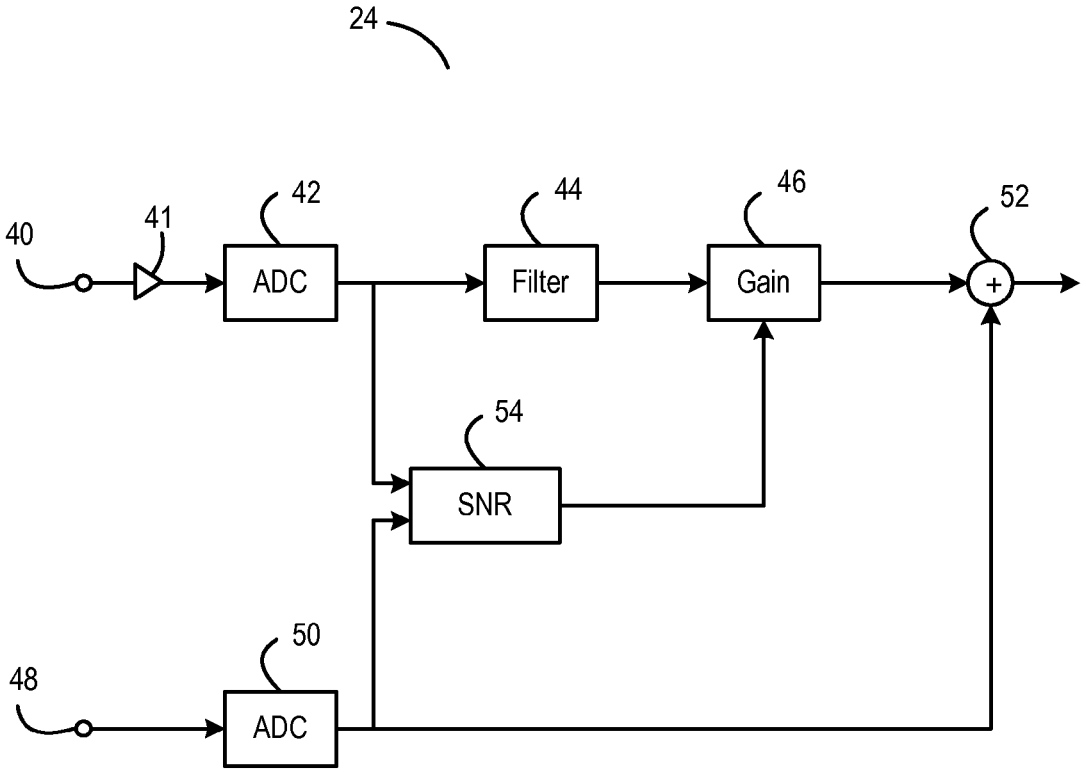
FIG. 12 illustrates a signal processing circuit in accordance with a further aspect of the invention in the noise cancellation system of FIG. 1.

FIG. 12 shows in more detail another embodiment of the signal processing circuitry 24. An input 40 is connected to receive a noise signal, for example directly from the microphones 20, 22, representative of the ambient noise. The noise signal is input to an analogue-to-digital converter (ADC) 42, and is converted to a digital noise signal. The digital noise signal is input to a filter 44, which outputs a filtered signal. The filter 44 may be any filter for generating a noise cancellation signal from a detected ambient noise signal, i.e. the filter 44 substantially generates the inverse signal of the detected ambient noise. For example, the filter 44 may be adaptive or non-adaptive, as will be apparent to those skilled in the art.

The filtered signal is output to a variable gain block 46. The control of the variable gain block 46 will be explained later. However, in general terms the variable gain block 46 applies gain to the filtered signal in order to generate a noise cancellation signal that more accurately cancels the detected ambient noise.

The signal processor 24 further comprises an input 48 for receiving a voice or other wanted signal, as described above. The voice signal is input to an ADC 50, where it is converted to a digital voice signal. Alternatively, the voice signal may be received in digital form, and applied directly to the signal processor 24. The digital voice signal is then added to the noise cancellation signal output from the variable gain block 46 in an adding element 52. The combined signal is then output from the signal processor 24 to the loudspeaker 28.

According to the present invention, both the digital noise signal and the digital voice signal are input to a signal-to-noise ratio (SNR) block 54. The SNR block 54 determines a relationship between the level of the voice signal and the level of the noise signal, and outputs a control signal to the variable gain block 46 in accordance with the determined relationship. In one embodiment, the SNR block 54 detects a ratio of the voice signal to the noise signal, and outputs a control signal to the variable gain block 46 in accordance with the detected ratio.

The term "level" (of a signal, etc) is used herein to describe the magnitude of a signal. The magnitude may be the amplitude of the signal, or the amplitude of the envelope of the signal. Further, the magnitude may be determined instantaneously, or averaged over a period of time.

The inventors have realized that in an environment where the ambient noise is high, such as a crowded area, or a concert, etc, a user of the noise cancellation system 10 will be tempted to push the system closer to his ears. For example, if the noise cancellation system is embodied in a phone, the user may press the phone closer to his ear in order to better hear the caller's voice.

However, this has the effect of pushing the loudspeaker 28 closer to the ear, increasing the coupling between the loudspeaker 28 in the ear, i.e. a constant level output from the loudspeaker 28 will appear louder to the user. Further, the coupling between the ambient environment and the ear will most likely be reduced. In the case of a phone, for example, this could be because the phone forms a tighter seal around the ear, blocking more effectively the ambient noise.

Both of these effects have the effect of reducing the effectiveness of the noise cancellation, by increasing the volume of the noise cancellation signal relative to the volume of the ambient noise, when the aim is that these should be equal and opposite. That is, the ambient noise heard by the user will be quieter, while the noise cancellation signal will be louder. Therefore, counter-intuitively, pushing the system 10 closer to the ear actually reduces the user's ability to hear the voice signal, because the noise cancellation is less effective.

According to the present invention, when the user has pushed the system 10 closer to his ear, the gain applied to the noise cancellation signal is reduced to counter the effects described above. A relationship between the noise signal and the voice signal is used to determine when the user is in an environment that he is likely to push the system 10 closer to his ear, and then to reduce the gain.

For example, in a noisy environment the SNR will be low, and therefore the SNR may be used to determine the level of gain to be applied in the gain block 46. In one embodiment, the gain may vary continuously with the detected SNR. In an alternative embodiment, the SNR may be compared with a threshold value and the gain reduced in steps when the SNR falls below the threshold value. In a yet further alternative embodiment, the gain may vary smoothly with the SNR only when the SNR falls below the threshold value.

Figure 13:
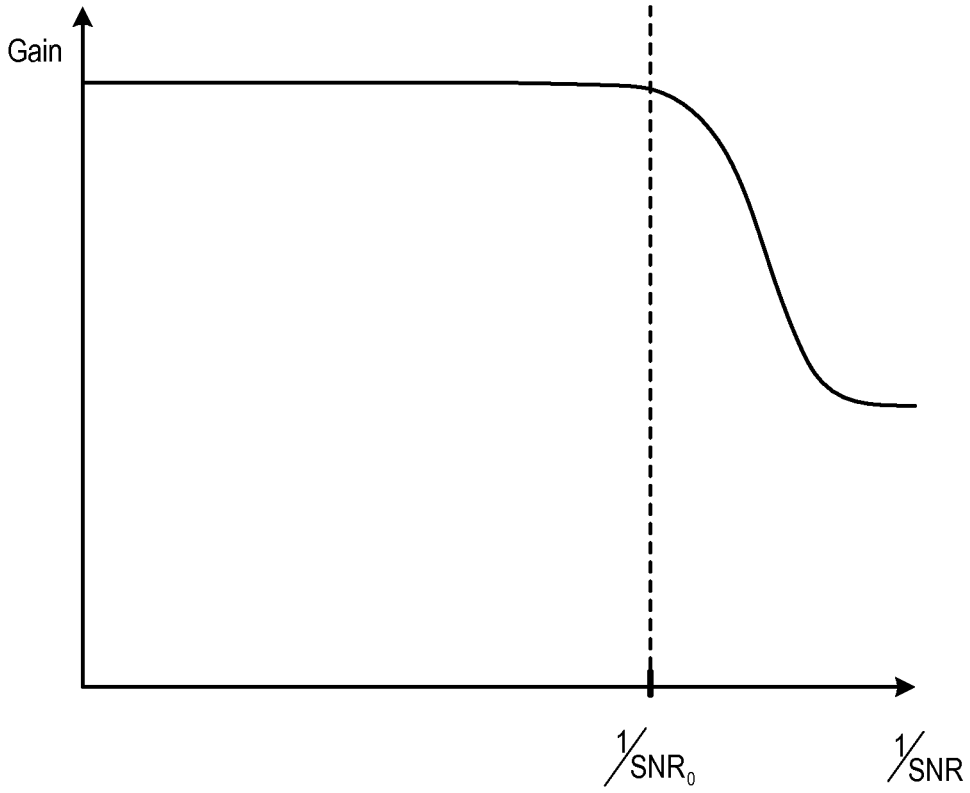
FIG. 13 is a schematic graph showing variation of gain with signal-to-noise ratio according to an embodiment of the present invention.

FIG. 13 shows a schematic graph of the gain versus the inverse of the SNR for one embodiment. As can be seen, the gain is reduced smoothly when the SNR falls below a threshold value $SNR_0$.

Comparison with a threshold value is advantageous because the user may not push the system 10 closer to his ear except in situations where ambient noise is a particular problem. Therefore, the threshold value may be set so that gain is only reduced at low SNR values.

According to a further embodiment, the signal processor 24 may comprise a ramp control block (not shown). The ramp control block controls the gain applied in the variable gain block 46 such that the gain does not vary rapidly. For example, when the system 10 is embodied in a mobile phone, the distance between the loudspeaker 28 and the ear may vary considerably and rapidly. In this instance it is preferable that the gain applied to the noise cancellation signal does not also vary rapidly as this may cause rapid fluctuations, irritating the user.

Various modifications may be made to the embodiments described above without departing from the scope of the claims appended hereto. For example, a digital voice signal and/or a digital noise signal may be input directly to the signal processor 28, and in this case the signal processor 28 would not comprise ADCs 42, 50. Further, the SNR block 54 may receive analogue versions of the noise signal and the voice signal, rather than digital signals.

It will be clear to those skilled in the art that the implementation may take one of several hardware or software forms, and the intention of the invention is to cover all these different forms.

Noise cancellation systems according to the present invention may be employed in many devices, as would be appreciated by those skilled in the art. For example, they may be employed in mobile phones, headphones, earphones, headsets, etc.

Furthermore, it will be appreciated that aspects of the present invention are applicable to any device comprising both a speaker and a microphone. For example, in such devices the present invention may be useful to give a first estimate of the sensitivity of one of, or both of, the speaker and the microphone. Examples of such devices include audio/video record/playback devices, such as dictation devices, video cameras, etc.

The skilled person will recognise that the above-described apparatus and methods may be embodied as processor control code, for example on a carrier medium such as a disk, CD- or DVD-ROM, programmed memory such as read only memory (firmware), or on a data carrier such as an optical or electrical signal carrier. For many applications, embodiments of the invention will be implemented on a DSP (digital signal processor), ASIC (application specific integrated circuit) or FPGA (field programmable gate array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (very high speed integrated circuit hardware description language). As the skilled person will appreciate, the code may be distributed between a plurality of coupled components in communication with one another. Where appropriate, the embodiments may also be implemented using code running on a field-(re-)programmable analogue array or similar device in order to configure analogue/digital hardware.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single processor or other unit may fulfil the functions of several units recited in the claims. Any reference signs in the claims shall not be construed so as to limit their scope.

The invention claimed is:

1. An ambient noise cancellation system, comprising:

an input for a digital signal representing ambient noise, the digital signal having a first sample rate;

a digital filter, connected to the input to receive the digital signal at the first sample rate;

a decimator, connected to the input to receive the digital signal at the first sample rate and to generate a decimated signal at a second sample rate lower than the first sample rate; and a processor, wherein the processor comprises:

a source input, for receiving a wanted signal;

an emulation of the digital filter, connected to receive the decimated signal at the second sample rate and to generate an emulated filter output;

an adder, for forming a sum of the emulated filter output and the wanted signal; and a control circuit, for generating a control signal on the basis of a comparison between said sum of the emulated filter output and the wanted signal and a threshold value, wherein the control signal is applied to the digital filter to control a filter characteristic thereof.

2. A noise cancellation system as claimed in claim 1, wherein the processor comprises a smoothing filter for smoothing said control signal to reduce noise in the noise cancellation system.

3. A noise cancellation system as claimed in claim 1, wherein the processor further comprises a warping block for generating the control signal.

4. A noise cancellation system as claimed in claim 1, wherein the emulation of the digital filter comprises a lower order approximation of the digital filter.

5. A noise cancellation system as claimed in claim 4, wherein the digital filter comprises a sixth order IIR filter, and the emulation of the digital filter comprises a second order approximation of the digital filter.

6. A noise cancellation system as claimed in claim 1, wherein the digital filter comprises a fixed part and an adaptive part.

7. A noise cancellation system as claimed in claim 6, wherein the emulation of the digital filter comprises an emulation of the adaptive part of the digital filter.

8. A noise cancellation system as claimed in claim 1, wherein the digital filter comprises a fixed part and an adaptive part, with the fixed part of the digital filter being connected to the input to receive the digital signal, and the adaptive part of the digital filter being connected to the fixed part of the digital filter to receive the input signal filtered by the fixed part of the digital filter;

wherein the decimator is connected to the fixed part of the digital filter to receive the input signal filtered by the fixed part of the digital filter; and wherein the emulation of the digital filter comprises an emulation of the adaptive part of the digital filter.

9. A noise cancellation system as claimed in claim 1, wherein the filter characteristic is a cut-off frequency of the digital filter.

10. A noise cancellation system as claimed in claim 1, wherein the digital signal is a signal representing frequencies in the audio range.

11. A noise cancellation system as claimed in claim 1, wherein the noise cancellation system is a feedforward noise cancellation system.

12. A noise cancellation system as claimed in claim 1, wherein the noise cancellation system is a feedback noise cancellation system.

13. An integrated circuit, comprising:

a noise cancellation system as claimed in claim 1.

14. A mobile phone, comprising:

an integrated circuit as claimed in claim 13.

15. A pair of headphones, comprising:

an integrated circuit as claimed in claim 13.

16. A pair of earphones, comprising:

an integrated circuit as claimed in claim 13.

17. A headset, comprising:

an integrated circuit as claimed in claim 13.

18. A method of cancelling ambient noise, comprising:

receiving a digital signal representing ambient noise, the digital signal having a first sample rate;

filtering said signal having the first sample rate with a digital filter;

generating a decimated signal from said digital signal having the first sample rate, the decimated signal having a second sample rate lower than the first sample rate;

emulating the digital filter using said decimated signal having the second sample rate, generating an emulated filter output;

receiving a wanted signal;

forming a sum of the emulated filter output and the wanted signal;

comparing said sum of the emulated filter output and the wanted signal with a threshold value; and controlling a filter characteristic of the digital filter on the basis of said comparison of said sum of the emulated filter output and the wanted signal with said threshold value.

19. A method as claimed in claim 18, further comprising:

receiving a wanted signal;

forming a sum of the emulated filter output and the wanted signal; and controlling the filter characteristic of the digital filter on the basis of a comparison between said sum of the emulated filter output and the wanted signal and a threshold value.

20. A method as claimed in claim 18, further comprising:

generating a control signal for controlling the filter characteristic of the digital filter; and smoothing said control signal to reduce noise in the noise cancellation system.

21. A method as claimed in claim 18, wherein said emulating the digital filter comprises approximating the digital filter with a lower order filter.

22. A method as claimed in claim 21, wherein the digital filter comprises a sixth order NR filter, and the emulation of the digital filter comprises a second order approximation of the digital filter.

23. A method as claimed in claim 18, wherein the digital filter comprises a fixed part and an adaptive part.

24. A method as claimed in claim 23, wherein said emulating of the digital filter comprises emulating the adaptive part of the digital filter.

25. A method as claimed in claim 18, wherein the digital filter comprises a fixed part and an adaptive part, with the fixed part of the digital filter receiving the digital signal, and the adaptive part of the digital filter receiving the input signal filtered by the fixed part of the digital filter; wherein the decimator receives the input signal filtered by the fixed part of the digital filter; and wherein emulating the digital filter comprises emulating the adaptive part of the digital filter.

26. A method as claimed in claim 18, wherein the filter characteristic is a cut-off frequency of the digital filter.

27. A method as claimed in claim 18, wherein the digital signal is a signal representing frequencies in the audio range.

* * * * *